US006838641B2

(12) United States Patent
Lein

(10) Patent No.: US 6,838,641 B2
(45) Date of Patent: Jan. 4, 2005

(54) THERMAL BINDING DEVICE

(75) Inventor: Torsten Lein, Pforzheim (DE)

(73) Assignee: Copy-Lein GmbH, Dessau (DE)

( * ) Notice: Subject to any disclaimer, the term of this patent is extended or adjusted under 35 U.S.C. 154(b) by 0 days.

(21) Appl. No.: 10/258,068

(22) PCT Filed: Apr. 17, 2001

(86) PCT No.: PCT/DE01/01500

§ 371 (c)(1),
(2), (4) Date: May 22, 2003

(87) PCT Pub. No.: WO01/78996

PCT Pub. Date: Oct. 25, 2001

(65) Prior Publication Data

US 2004/0104214 A1 Jun. 3, 2004

(30) Foreign Application Priority Data

Apr. 18, 2000 (DE) ..... 100 19 510

(51) Int. Cl.[7] ..... H05B 1/00; B42B 5/00
(52) U.S. Cl. ..... 219/221; 412/9; 412/33
(58) Field of Search ..... 219/221, 481, 219/492, 497; 412/9, 11, 33

(56) References Cited

U.S. PATENT DOCUMENTS 4,108,713 A 8/1978 Weisz
5,454,680 A 10/1995 Lazar
5,549,433 A * 8/1996 Byrne ..... 412/39
5,556,490 A 9/1996 Tholerus
5,569,012 A * 10/1996 Kosasa et al. ..... 412/33
5,910,263 A 6/1999 Weiffenbach
6,009,924 A * 1/2000 Peleman ..... 156/350
6,637,996 B1 * 10/2003 Hayakawa et al. ..... 412/9
6,652,210 B1 * 11/2003 Yeaple ..... 412/37

FOREIGN PATENT DOCUMENTS

EP 0 798 132 10/1997

* cited by examiner

*Primary Examiner*—Robin O. Evans
*Assistant Examiner*—Vinod Patel
(74) *Attorney, Agent, or Firm*—Collard & Roe, P.C.

(57) ABSTRACT

The invention relates to a device for producing bound written material with representative covers, for marketing texts, magazines, construction plans, collections of drawings, contracts, offers and promotional literature (catalogues) as required in small to medium sizes. A heatable ceramic surface with an integrated heating element has several inductive and thermal sensors on its underside, for detecting covers with a metal inlay and for controlling the heat output. Said inductive sensors are partially also supplemented with sensors with microswitches, optical sensors and additionally, a pressure sensor if the device is to be used for binding covers consisting of non metallic materials at the same time. The very short time for heating up the ceramic heating surface made technically possible by the invention and the use of the stored temperature is made optimal use of through an internal flap system which is motor-operated. Integrated ventilators ensure controlled ducted cooling which can also be supported by Peltier elements embedded in the ceramic heating surface. The inventive device can be used for binding different formats (DIN A4, DIN A5) and thicknesses.

11 Claims, 8 Drawing Sheets section view rotaded detail X

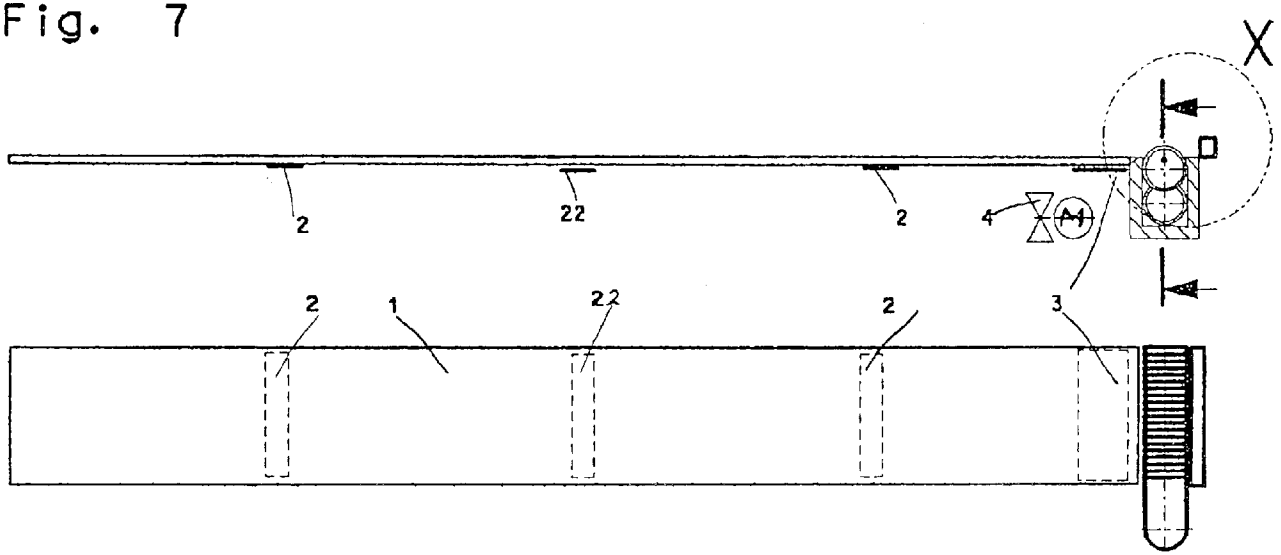
Fig. 7
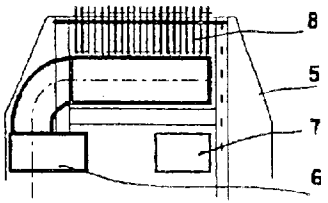

THERMAL BINDING DEVICE

CROSS REFERENCE TO RELATED APPLICATIONS

Applicant claims priority under 35 U.S.C. §119 of German Application No. 100 19 510.5, filed Apr. 18, 2000. Applicant also claims priority under 35 U.S.C. §365 of PCT/DE01/01500, filed Apr. 17, 2001. The international application under PCT article 21(2) was not published in English.

BRIEF SUMMARY OF THE INVENTION

The invention relates to a device for producing bound written material with representative covers, for marketing texts, magazines, construction plans, collections of drawings, contracts, offers and promotional literature (catalogues) as required in small to medium series.

Application is designed for personal and commercial use, in particular for tasks in architects', engineers' and designers' offices as well as in tax accountants' and lawyers' offices and schools, authorities or advertising agencies.

For binding loose written or other printed pages in relatively small print runs there are already sophisticated technical solutions that have been more or less described and have been applied up to now.

By taking the technical solutions hereafter referred to, the state of the art is to be documented in principle.

The Swiss patent CH 677053 A5 presents a device for binding pages by warming them, whereby an aluminium rail with recesses for heating elements is aligned in the interior of an octagonal casing. The set-up permits the simultaneous binding of 2 folders, whereby the switching duration of the PTC resistor heating elements can be time-regulated by means of the electronics installed. The compact design has the advantage that it is easy to operate on the one hand, but on the other hand the drawback is that the clock cycles between heating and cooling are high and therefore energy is "squandered". To shorten this time-related disadvantage, additional ventilation slits in the floor of the casing are proposed.

In the European patent application EP 0 489 336 A1 a table device for binding a bundle of papers, along a joint edge, is proposed. The technical process of producing bound products combines the stages of laminating and binding. Prefabricated covers cannot be used together here with loose pages. The heating energy is brought in via several blocks of heat-conducting material, consisting especially of aluminium, whereby the cooling process is no longer supported technically. Several pairs of rolls are used as a conveyor, which is to be regarded as costly and mechanically inadequate.

The U.S. patent application Ser. No. 5,829,938 also presents a heatable table device, with which a predetermined pile of paper is "gathered" by means of an L-shaped binding volume wetted with adhesive after being inserted and heated electrically, and then a short print is applied onto the area to be glued by manual slewing, in the meaning of "edging". Special measures for the effective use of heating energy once brought in and its shielding for the purpose of short-term cooling are not provided for, whereby subsequent "packaging" in a cover, which is independent of this, also has to be carried out.

According to the European patent application EP 0 841 192 A1 there is now an electrically heatable table device with multiple recordings of a defined width for binding pages or forms, whereby time-controlled heating of the covers, which in turn have an adhesive inlay, fitted with the pages/forms means that the optimum "ejection" time can be initiated with switchable magnetic contacts. The warming still present in the heating element at this moment can lead to "warping" of the cover if the heating time is not set properly.

These disadvantages taken from the state of the art are now to be overcome, whereby the task of the invention should be to improve the energy ratios of known binding devices, to allow covers to be bound from metallic or non-metallic materials alike and, in addition, to allow different formats of the pages or forms to be bound with technology that controls the optimum binding duration, whereby there should be no restrictions in the binding folders that can be used.

According to the invention, the task is solved in the following way, whereby the basic inventive ideas are set out here.

The central element of the binding device is represented as a longitudinal and internally stable ceramic surface that can be heated and cooled rapidly, on the underside of which there is a heating element. The inductive sensors, which may be aligned in pairs or several towards each other, are located under the ceramic surface and trigger the heating of the ceramic surface when a binding folder is inserted, up to the optimum softening point of the adhesive material deposited in the back of a metallic cover, whereby sensors distributed over the heating surface of this ceramic surface have a monitoring function. In this way faulty bindings are avoided and warping of the book cover through overheating is excluded from the start by means of precisely set temperatures and control times, which can be regulated electrically.

In addition to the use of covers with a stiff metallic inlay, folders can be produced which are designed in a different way, namely those produced from plastic materials, cardboard or coated materials.

For this purpose, in addition to the previously mentioned inductive sensors, there are also one or several mechanically attachable sensors in the width of the heating surface, whereby the lowering of a lateral stem, which is spring-loaded on both sides, means that the heating contact can be initiated by operating an optical or microswitch or can be switched off at any time by means of the reading via the existing thermal sensors. A further sensor, designed in a lateral slit of the ceramic heating surface partially protruding upwards, e.g. in the form of a wire coil, is in electrical contact when loaded with a contact wire/resistance wire, by which the electrical resistance can be recorded microelectronically measured against the width of any kind of cover or its weight and supports the heating and switching-off operation of the thermal sensors, while the required heating time is determined.

In an additional formation, which secures the function, the sensor has an internally aligned tube on its underside as well as an adjustment function for setting a defined print, whereby the load applied by inserting a cover is in active connection with a print-recording sensor and/or switch. The latter then triggers the start of the heating of the ceramic heating surface.

The position of the sensor can be in the centre of the ceramic heating surface or at the end of the same, whereby in the latter case an end stop forms the end of the ceramic heating surface.

The fact that the technology for heating and cooling the ceramic heating surface can be readily controlled is further improved in the device with an installed ventilator for cooling.

The time for warming (heating time) can also be controlled by a pressure sensor depending on the different weight of the binding folders.

BRIEF DESCRIPTION OF THE DRAWINGS

In the following the invention is described in more detail with a design example.

Drawings have been used by taking FIGS. 1–16.

The individual figures represent:

Figure 1:
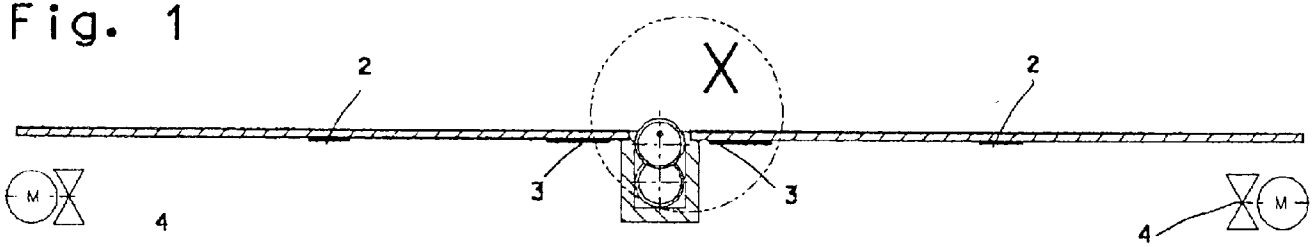

FIG. 1: a side view in section with a centrally aligned sensor

Figure 2:
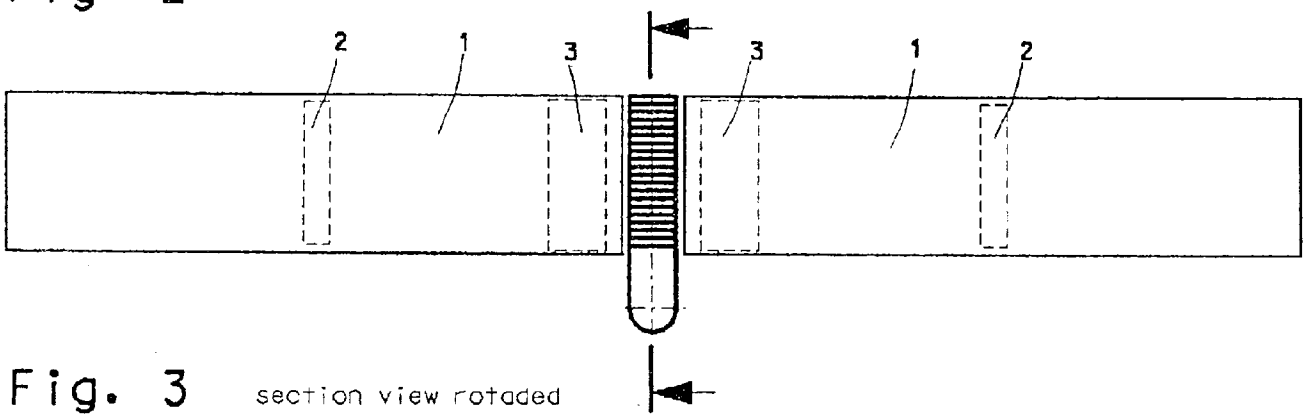

FIG. 2: a top view according to FIG. 1

Figure 3:
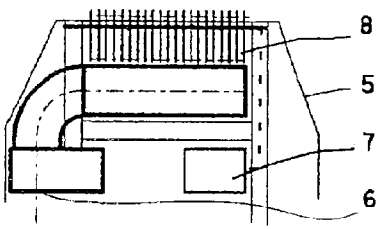

FIG. 3: a representation of the sensor

Figure 4:
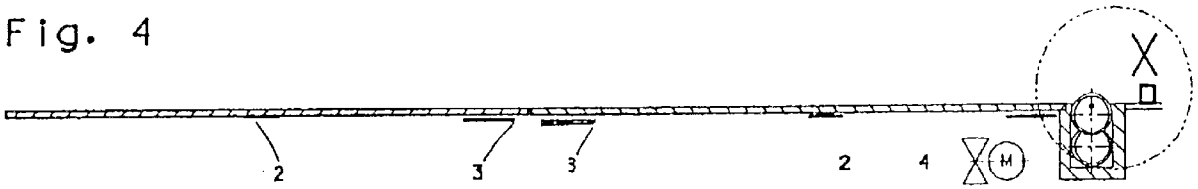

FIG. 4: a side view in section with the sensor aligned on the side (end stop left of right)

Figure 5:
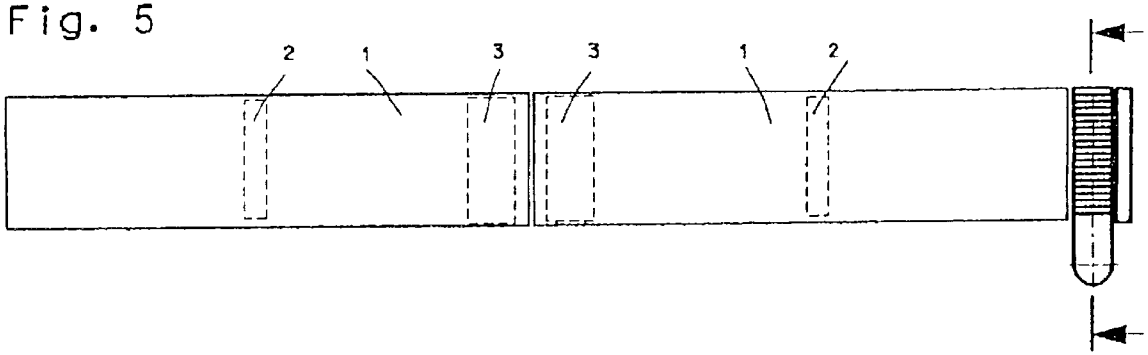

FIG. 5: a top view according to FIG. 4

Figure 6:
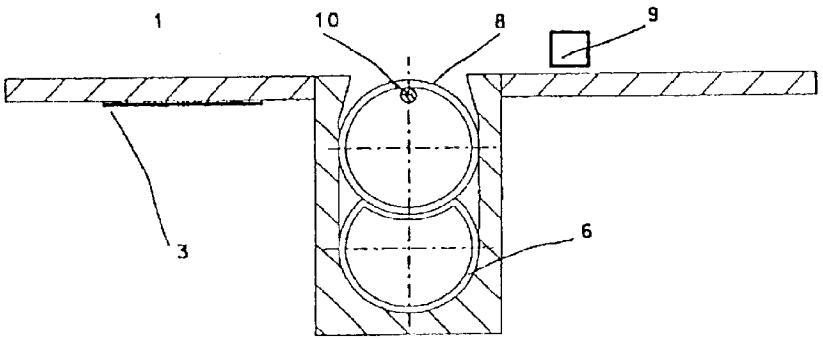

FIG. 6: the sensor in cross section as detail "X"

FIG. 7: the ceramic heating surface with pressure sensor

Figure 8:
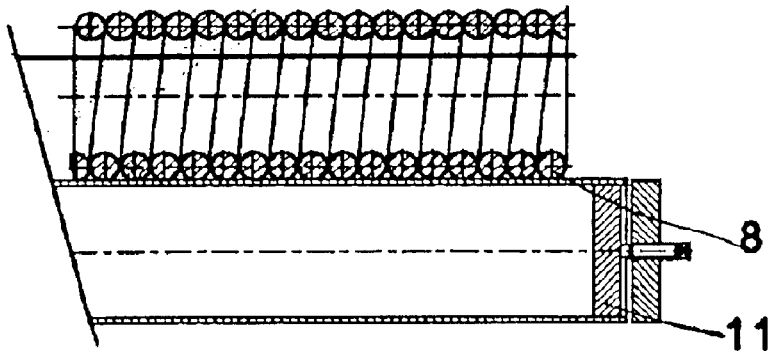

FIG. 8: the sensor in section (without loading)

Figure 9:
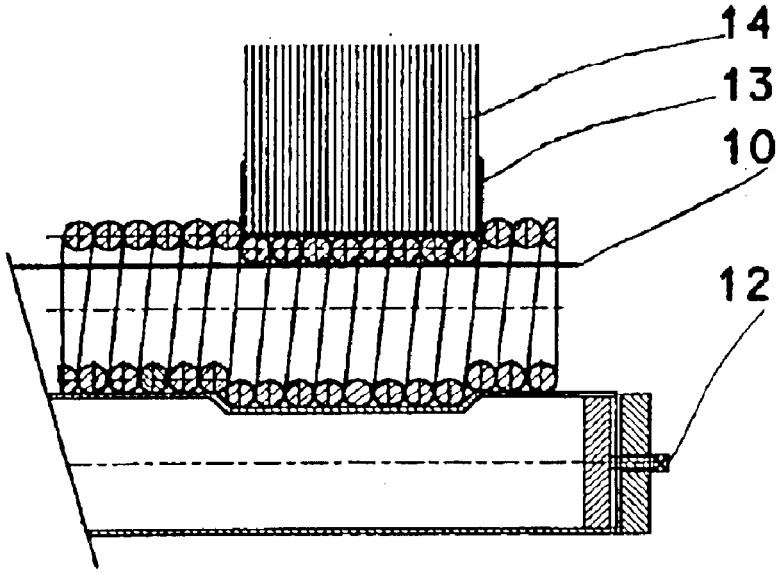

FIG. 9: with the sensor in section (with loading)

Figure 10:
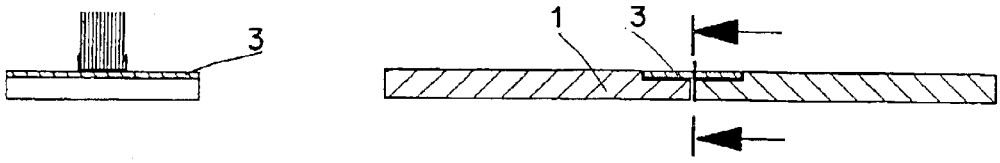

FIG. 10: the ceramic heating surface with direct temperature sensor

Figure 11:
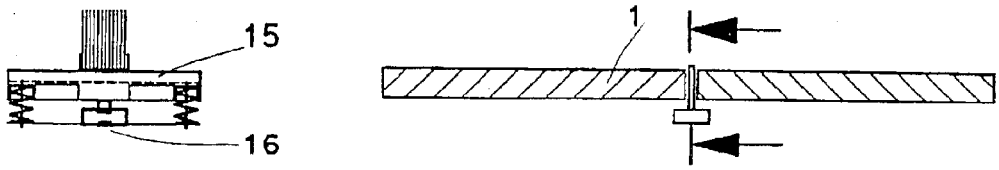

FIG. 11: the ceramic heating surface with microswitch in section

Figure 12:
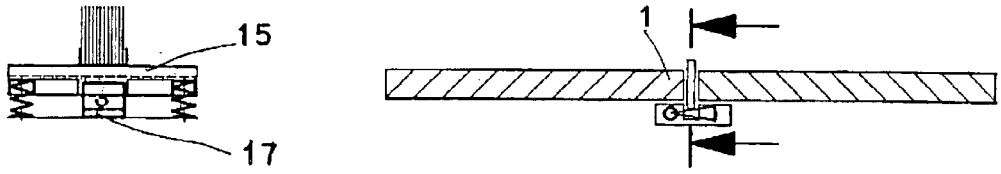

FIG. 12: the ceramic heating surface with an optical sensor/echo sensor

Figure 13:
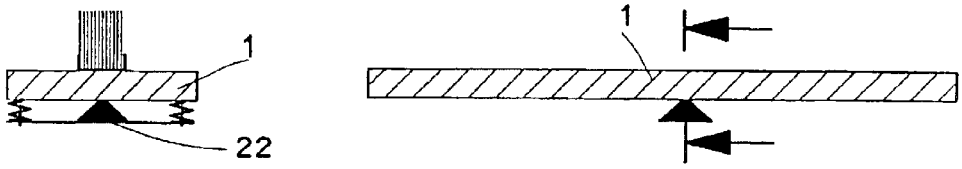

FIG. 13: the ceramic heating surface with a pressure sensor

Figure 14:
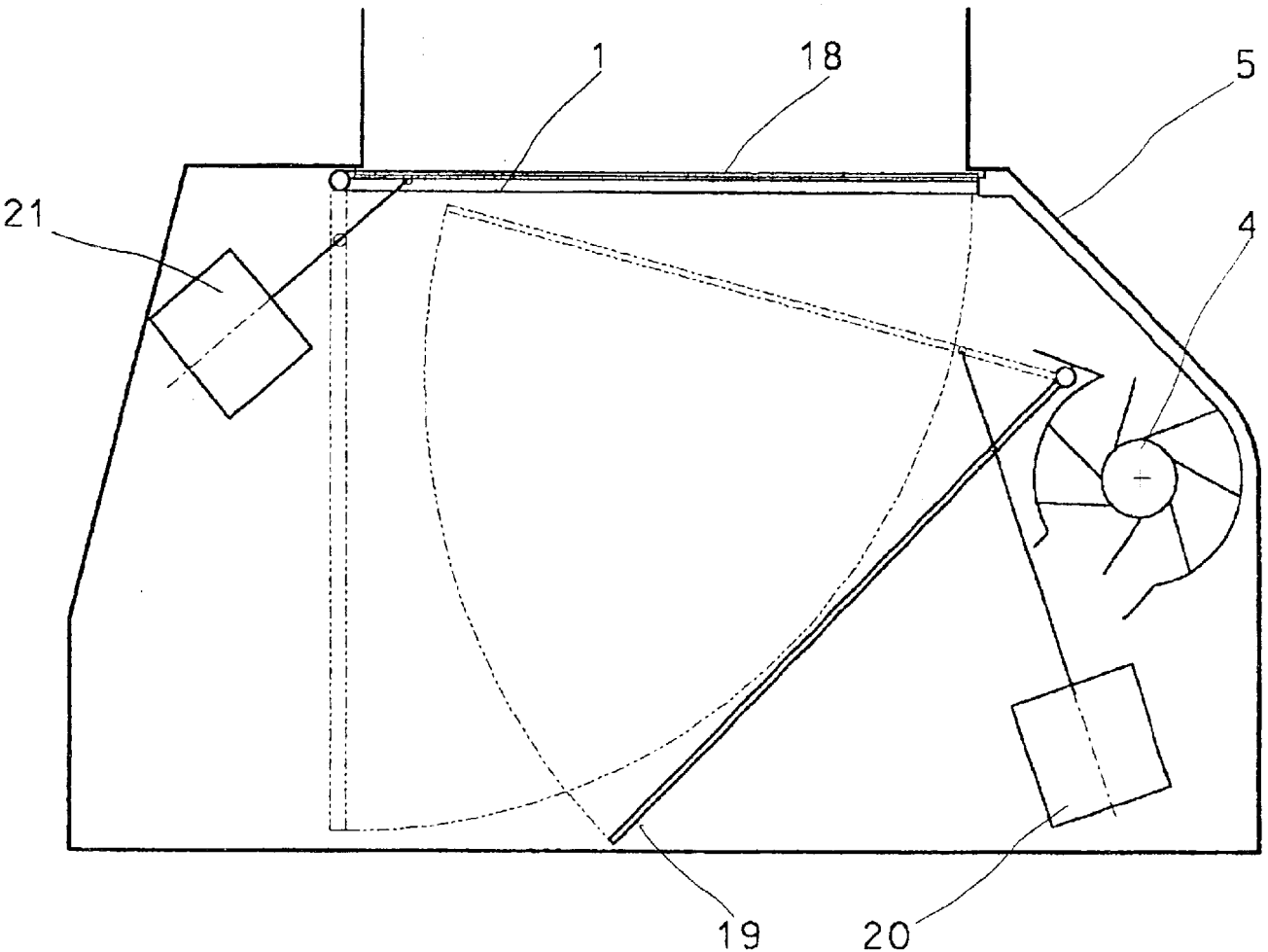
Figure 15:
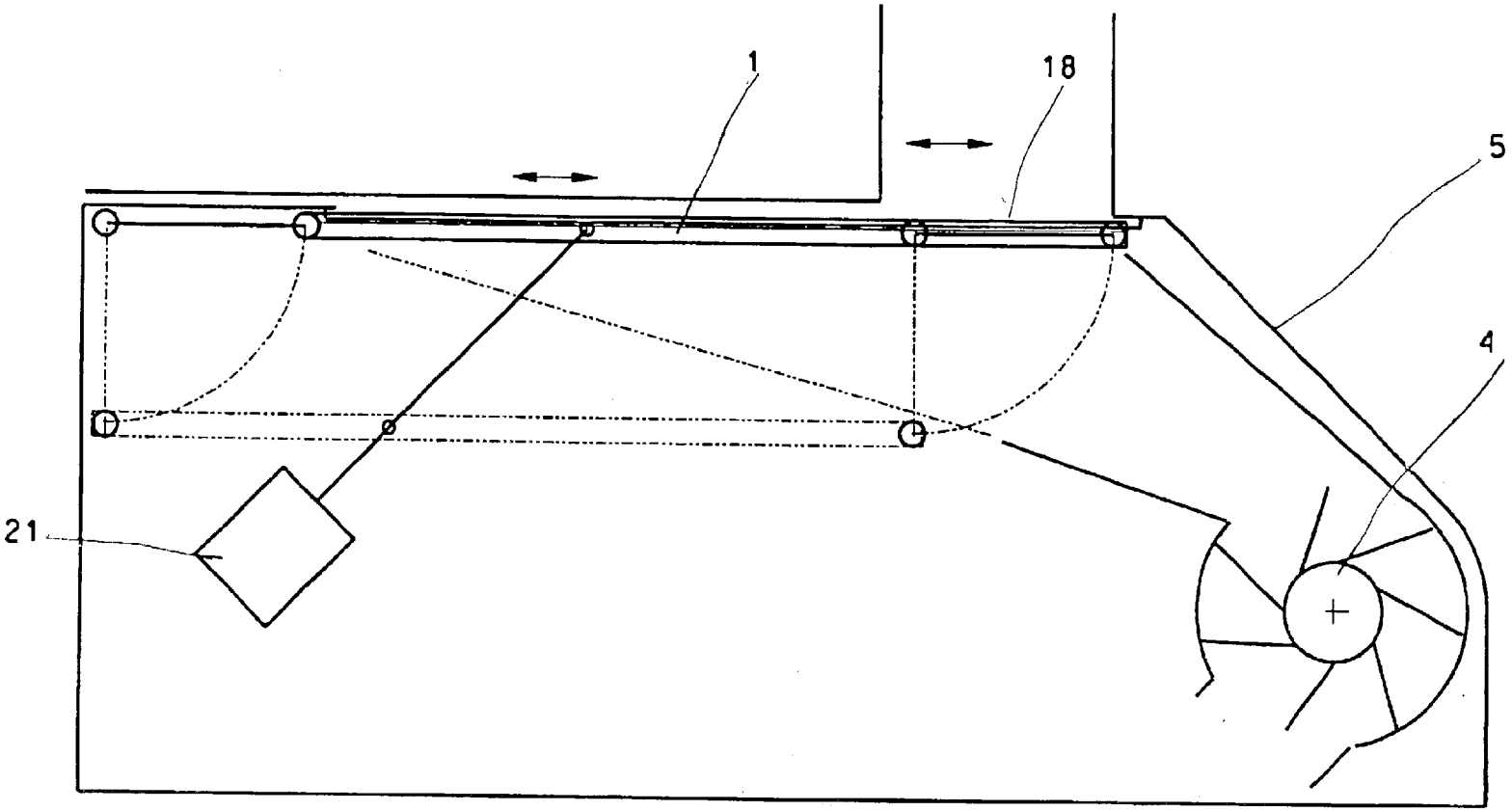
Figure 16:
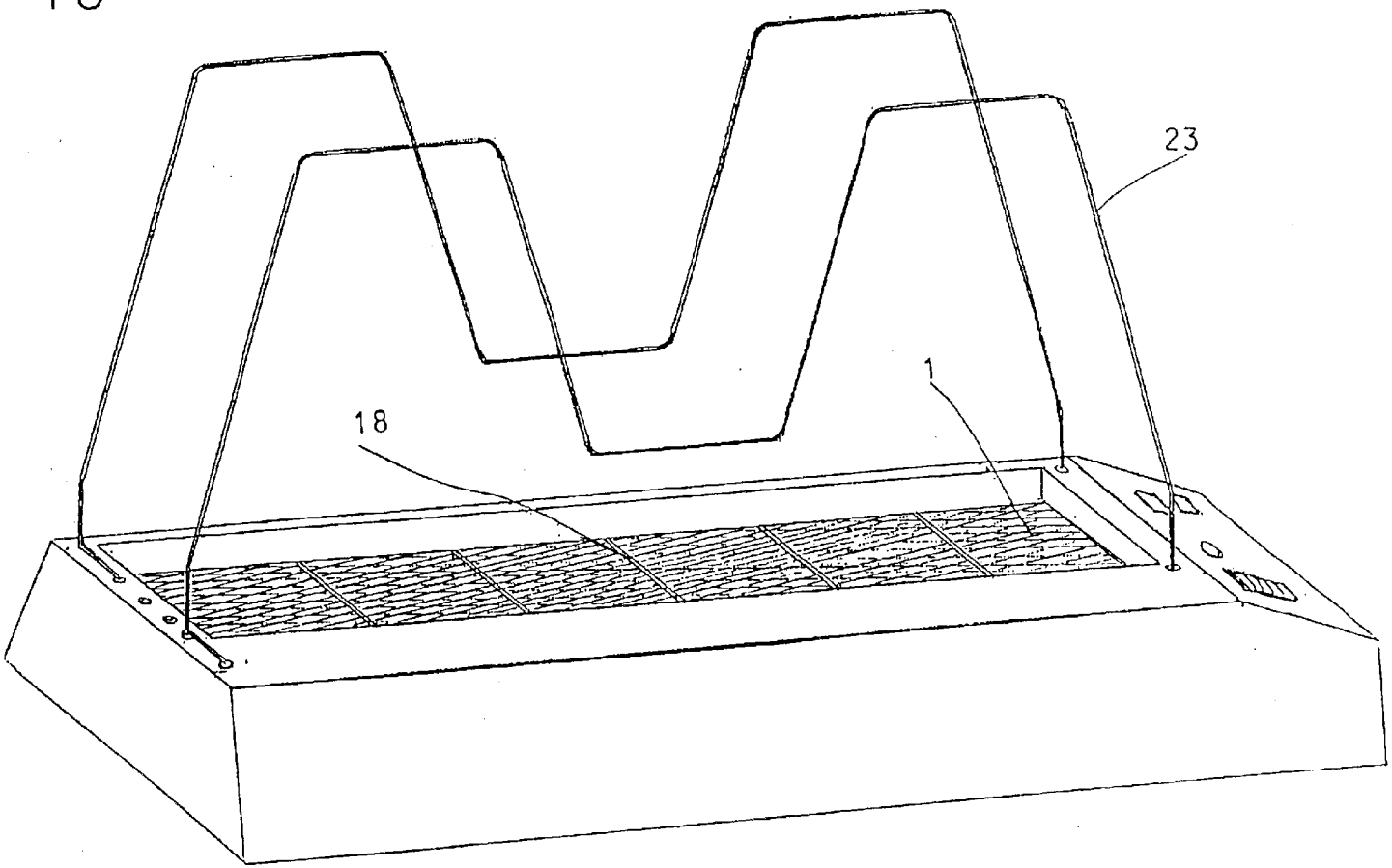

FIG. 14: a cross-section through the binding device with a hinged heating element FIG. 15: a cross-section through the binding device with lowerable heating plate FIG. 16: a view of the thermal binding device The reference marks used in the individual figures have the following meaning

1—ceramic heating surface
2—thermal sensor
3—inductive sensor
4—motor-operated ventilator
5—casing
6—flexible tube with pressure switch/sensor
7—switch
8—wire coil
9—end stop
10—contact wire/resistance wire
11—bulb
12—adjusting screw
13—cover
14—pages
15—cross member
16—microswitch/switch/echo sensor
17—optical sensor
18—lateral stem
19—base plate
20—motor for base plate
21—motor for ceramic heating surface
22—pressure sensor
23—holding pins

DETAILED DESCRIPTION OF THE INVENTION

In a thermal binding device the ceramic heating area 1 is situated on the top side of the casing 5. To support the pages 14 to be bound as well as the cover 13, holding pins 23 are fitted in pairs over the side of the ceramic heating surface 1.

The ceramic heating surface 1, on the underside of which a heating element is integrated or a Peltier element attached, also has one or several inductive sensors 3 and thermal sensors 2 on its underside, which trigger the heating process on the one hand and switch off the heating process on the other after the optimal melting of the binding adhesive has been achieved and the pages 14 have been lowered into the cover 13.

The reaching of the melting temperature of the adhesive is influenced by the different materials of the binding folders. Different materials require different binding temperatures and different binding times. For detecting covers/binding folders without metal inlays, microswitches or optical sensors are used as an alternative and can be attached via a lateral stem 15.

The pressure sensor 22 records the appropriate binding width and the binding time required for this from the weight of a folder at a preset binding temperature independent of the binding folder material.

With the alignment of a sensor consisting of the elements a flexible tube 6, switch 7 and wire coil 8, in the area of the ceramic heating surface 1, the binding folder width is detected and the heating time is regulated precisely.

The wire coil 8 serves the same purpose in contact with the contact wire/resistance wire 10 as a result of loading by the binding folder. The resistance changed by this in the contact wire/resistance wire 10 is used as the width of the binding folder to regulate the heating. Suitably there is in addition to this the end stop 9 when the wire coil 8 is in a side position. Under the wire coil 8 the flexible tube 6 with a bulb 11 and the adjusting screw 12 is aligned to adjust the output signal.

Along the ceramic heating surface 1 one/or a series of Piezo elements can be aligned on its underside, which convey the sinking of the pates 14 into a cover 13 by oscillation and vibration during the melting of the binding adhesive.

For the rapid cooling of bound covers one or several motor-operated ventilators 4 are positioned underneath, on the side of the ceramic heating surface 1, whereby a hinged, motor-operated base plate 19 is used so that the generated air currents only reach the cover/covers 13 and the residual heating energy of the ceramic surface 1 is not activated as far as possible. The drive for the base plate 19, i.e. the motor, is designated with the position mark 20. For this purpose the ceramic heating surface 1 can be hinged additionally by means of a motor 21. The cooling process has an advantageous time-accelerating construction with Peltier elements that can be switched in near the covers 13. It is possible to fit a lateral stem 18 to serve as a resting surface for the binding material, for the case that the ceramic heating surface 1 is designed to shift sideways for the purpose of cooling.

What is claimed is:

1. A thermal binding device characterised by the fact that in the upper part of the casing (5) one or several ceramic beating surfaces (1) are aligned, consisting of a hybrid thick-layer material, and essentially inductive sensors (3), thermal sensors (2) and a pressure sensor (22) are located on the underside of the ceramic surface (1) as well as a combination, consisting of a flexible tube (6), a switch (7) and a wire coil (8) are provided in the centre or at the side on the level of the ceramic hearing surface (1) and an integrated cooling unit.

2. A thermal binding device according to claim 1 characterised by the fact that instead of the inductive sensor or sensors (3) a sensor with a spring-loaded cross member (15) and a microswitch (16) and/or an optical sensor or echo sensor (17) is/are connected functionally with the ceramic heating surface (1).

3. A thermal binding device according to claim 1 characterised by the fact that the ceramic heating surface (1) consists of one or several surfaces.

4. A thermal binding device according to claim 1 characterised by the fact that Piezo elements causing oscillations are in contact with the ceramic heating surface (1).

5. A thermal binding device according to claim 1 characterised by the fact that a wire coil (8) and/or a flexible tube (6) in the meaning of a sensor and/or microswitch (16) are attached between or to the ends of the heating surface (1) in such a way that the measured width of the binding folders can be evaluated and, when converted, is integrated into the binding process for the purposes of time and temperature regulation.

6. A thermal binding device according to claim 1 characterised by the fact that the cooling of a cover (13) is directly caused by a motor-operated ventilator (4) in such a way that the ceramic heating surface (1) can be moved away by a motor and that a base plate (19) is aligned so that it can be hinged upwards between the cover (13) and the ceramic heating surface (1).

7. A thermal binding device according to claim 6 characterised by the fact that for the purpose of cooling the cover (13) the ceramic heating surface (1) can be removed at the side and parallel to the former and a lateral stem (18) is provided to support the binding material.

8. A thermal binding device according to claim 1 characterised by the fact that in addition to the forced cooling by means of a motor-operated ventilator (4), further Peltier elements are installed.

9. A thermal binding device according to claim 1 characterised by the fact that Peltier elements are used to heat the ceramic heating surface (1) alone or together with the ceramic heating surface (1) fitted with a heating element.

10. A thermal binding device according to claim 1 characterised by the fact that one or several Peltier elements are used for heating and cooling in connection with the ceramic heating surface.

11. A thermal binding device according to claim 1 characterised by the fact that with the aid of a pressure sensor (22) the binding time (heating time) can be regulated from the weight of the binding material at a preset temperature.

* * * * *

UNITED STATES PATENT AND TRADEMARK OFFICE

CERTIFICATE OF CORRECTION

PATENT NO. : 6,838,641 B2
DATED : January 4, 2005
INVENTOR(S) : Lein

It is certified that error appears in the above-identified patent and that said Letters Patent is hereby corrected as shown below:

Column 4,
Lines 59 and 65, please change “beating” to correctly read -- heating --.

Signed and Sealed this

Second Day of August, 2005

JON W. DUDAS
*Director of the United States Patent and Trademark Office*